US012466688B2

(12) United States Patent
Ambartsoumian

(10) Patent No.: US 12,466,688 B2
(45) Date of Patent: Nov. 11, 2025

(54) DEVICE FOR MANUFACTURING TAPE WITH TEAR CUTS

(71) Applicant: Gourgen Ambartsoumian, Laval (CA)

(72) Inventor: Gourgen Ambartsoumian, Laval (CA)

( * ) Notice: Subject to any disclaimer, the term of this patent is extended or adjusted under 35 U.S.C. 154(b) by 233 days.

(21) Appl. No.: 18/454,137

(22) Filed: Aug. 23, 2023

(65) Prior Publication Data

US 2024/0067488 A1 Feb. 29, 2024

Related U.S. Application Data

(60) Provisional application No. 63/400,063, filed on Aug. 23, 2022.

(51) Int. Cl.
*B65H 35/00* (2006.01)

(52) U.S. Cl.
CPC ..... *B65H 35/008* (2013.01)

(58) Field of Classification Search
CPC ..... B65H 35/008; B26D 2001/0033; B26D 2001/006; B26D 1/0006; B26D 1/065; B26D 1/141; B26D 1/225; B26D 1/345; B26D 1/405; B26D 3/12; B26F 1/20
See application file for complete search history.

(56) References Cited

U.S. PATENT DOCUMENTS 3,186,362 A * 6/1965 Iannuzzi, Sr. ..... A21C 9/068 425/298
3,293,962 A * 12/1966 Gianaris ..... B26D 1/245 83/345
11,059,113 B2 * 7/2021 Murphy ..... B26D 5/02
2016/0237320 A1 8/2016 Yamamoto et al.
2019/0233680 A1 8/2019 Liu et al.

FOREIGN PATENT DOCUMENTS

DE 102006038723 A1 2/2008

OTHER PUBLICATIONS

Circular Knives, PortageKnife Company. https://portageknife.com/products/circular-knives/.
DuraLine Flexible Die, Maxcess https://www.maxcessintl.com/product/rotary-dies/flexible-dies/duraline-flexible-die/.
AccuPrime™ Flexible Die (Standard Paper & Film Applications), Maxcess https://www.maxcessintl.com/product/rotary-dies/flexible-dies/accuprime-flexible-die/.
Magnetic Cylinders, Maxcess https://www.maxcessintl.com/product/rotary-dies/magnetic-cylinders/.

* cited by examiner

*Primary Examiner* — Michael A Tolin
*Assistant Examiner* — Christopher C Caillouet
(74) *Attorney, Agent, or Firm* — NORTON ROSE FULBRIGHT CANADA LLP

(57) ABSTRACT

A slitter device comprising a circular blade at an outer periphery of the slitter device. One or more row of transverse blades at the outer periphery and on a side of the circular blade, the blades of the row of transverse blades being oriented transversely relative to the circular blade.

20 Claims, 7 Drawing Sheets

DEVICE FOR MANUFACTURING TAPE WITH TEAR CUTS

CROSS-REFERENCE TO RELATED APPLICATION

The present application claims the priority of U.S. Patent Application No. 63/400,063. filed on Aug. 23, 2022 and incorporated herein by reference.

TECHNICAL FIELD

The present application relates to a device for manufacturing a polymeric tape of the type commonly found in rolls, and used for example as a marking tape, and to a method of fabricating such a polymeric tape with tear cuts.

BACKGROUND

Polymeric tape is commonly used for a wide spectrum of applications such as labelling, identifying, decorating, wrapping, packaging, sealing, masking, laminating, sticking to a surface, color-coding, fusing, indicating (such as thermochromic ink tapes), container closing, painting, informational, clinging such as static cling, etc. Such applications may be for various industries including medical, biomedical, industrial, electrical, electronic, construction, plumbing, roofing, automotive, avionics, aerospace, scientific, cryogenic, freezer, high-temperature, office use, packaging, shipping, arts, etc. Polymeric tape typically has a facestock having the capacity of retaining ink or be printed. Accordingly, information may be inscribed on the facestock marking tape to label things. In particular, polymeric marking tape, in which the substrate is a polymer, is used for its capacity to retain ink. Other types of tapes are used for sealing, securing or isolating objects such as electrical tape, packaging tape, duct tape, silicone tape, and others where facestocks in some of those tapes might not need to have a capability to retain ink. Yet in other applications tapes might be used for sticking together objects or surfaces, such as double-sided or mounting tapes which might not require capacity of retaining ink or such as an adhesive transfer tape where the adhesive is contained between two support liners for a future removal of one of the support liners and the transfer of the adhesive to a facestock or a surface or an object.

A characteristic of some polymers is that they may stretch when subjected to shear forces. This may for example be the case with thermoplastic film materials, silicone rubber materials, laminated paper, cloth, fabrics, laminated fabrics, laminated metallic foils, etc. Therefore, if a user wants to have a segment of an elongated polymeric tape, such as in a roll of polymeric tape, the user may need scissors or a knife to cleanly segment a portion of the polymeric tape from the roll. Otherwise, by using manual force to rip or tear tape from a roll, a user may unduly stretch the tape, which may result in waves, loss of adherence, erratic shape, excessive length, among other things. In some cases, the polymeric films are rigid and tear-resistant, making them difficult to tear manually.

Accordingly, a polymeric tape with tear cuts has been described in U.S. Pat. No. 11,319,464, the content of which is incorporated herein by reference. In a variant, the tape described in U.S. Pat. No. 11,319,464 has a polymer facestock with transverse cuts, such as micro-cuts, penetrating the exterior edge or edges of the facestock. This may facilitate a manual tearing of a segment of tape by a user's hand. There are however challenges in manufacturing such a polymeric tape with tear cuts.

SUMMARY OF THE INVENTION

It is an aim of the present disclosure to provide a device for manufacturing a polymeric tape with tear cuts.

Therefore, in accordance with a first aspect of the present disclosure, there is provided a slitter device comprising: a circular blade at an outer periphery of the slitter device; and at least one row of transverse blades at the outer periphery and on a side of the circular blade, the blades of the row of transverse blades being oriented transversely relative to the circular blade.

Further in accordance with the first aspect, for instance, there may be two rows of the transverse blades, with the rows being on opposite sides of the circular blade.

Still further in accordance with the first aspect, for instance, the transverse blades intersect the circular blade.

Still further in accordance with the first aspect, for instance, at least one of the transverse blades lies in a plane perpendicular to a radial plane of the circular blade.

Still further in accordance with the first aspect, for instance, all of the transverse blades lie in planes perpendicular to a radial plane of the circular blade.

Still further in accordance with the first aspect, for instance, edges of the transverse blades are radially inward of an edge of the circular blade.

Still further in accordance with the first aspect, for instance, the edges of the transverse blades are radially inward of the edge of the circular blade by a distance generally equal to a thickness of a support liner.

Still further in accordance with the first aspect, for instance, at least one row of transverse blades project from an annular base.

Still further in accordance with the first aspect, for instance, the at least one row of transverse blades includes triangular prisms projecting from the annular base.

Still further in accordance with the first aspect, for instance, the transverse blades are fins.

Still further in accordance with the first aspect, for instance, the circular blade is part of a disc body of the slitter apparatus.

Still further in accordance with the first aspect, for instance, the disc body has a central bore.

In accordance with a second aspect of the present disclosure, there is provided a cutting die device comprising: a plate body configured to be positioned on a cylindrical surface; circumferential blade edges projecting from a plane of the plate body, the circumferential blade edges configured to extend along a circumference of the cylindrical surface; at least one row of transverse blade edges projecting from the plane of the plate body, the transverse blade edges being oriented transversely relative to the circumferential blade edges.

Further in accordance with the second aspect, for instance, there may be two rows of the transverse blade edges, with the rows being on opposite sides of one of the circular blade edges.

Still further in accordance with the first aspect, for instance, there may be two rows of the transverse blade edges, with each one of the rows adjacent to a respective one of the circumferential blade edges.

Still further in accordance with the first aspect, for instance, the transverse blade edges intersect one of the circumferential blade edges.

In accordance with a third aspect of the present disclosure, there is provided a cutting die shaft comprising: a shaft body having a cylindrical surface; circumferential blade edges projecting from the cylindrical surface, the circumferential blade edges configured to extend along a circumference of the cylindrical surface; at least one row of transverse blade edges projecting from the cylindrical surface, the transverse blade edges being oriented transversely relative to the circumferential blade edges.

Further in accordance with the third aspect, for instance, there may be two rows of the transverse blade edges, with the rows being on opposite sides of one of the circular blade edges.

Still further in accordance with the third aspect, for instance, there may be two rows of the transverse blade edges, with each one of the rows adjacent to a respective one of the circumferential blade edges.

Still further in accordance with the third aspect, for instance, the transverse blade edges intersect one of the circumferential blade edges.

BRIEF DESCRIPTION OF THE EMBODIMENTS

Figure 13:
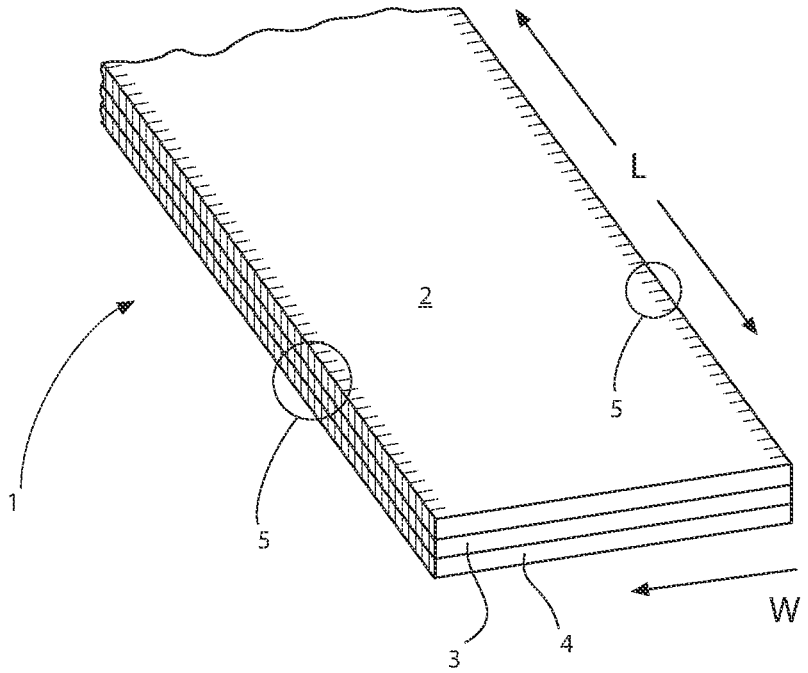
FIG. 13 is a schematic perspective view of an exemplary polymeric tape with tear cuts.

A polymeric tape with micro-cuts that may be manufactured with the devices described herein may be an elongated strip of tape or may be part of a roll, and is as described in U.S. Pat. No. 11,319,464, the content of which is incorporated herein by reference. For ease of reference, a polymeric film or tape with tear cuts that may be fabricated with devices described herein is shown in FIG. 13, and is generally shown as 1. The polymeric tape 1 may be of the type that may be used to manually inscribe information thereon, and may be in the form of strips, of a tape roll, etc. As a tape roll, the polymeric tape may also be of the type used by a printer. Some printers such as thermal printers are equipped with a cutting mechanism which is a sharp knife that moves perpendicular to the feeding direction of the printer and segments the desired length of the tape. Other devices such as tape dispensers are also equipped with cutting, dispensing and in some cases peeling mechanisms. Although the tape is primarily intended for manual cutting, the tape can be also cut, dispensed and/or peeled using various types of cutters incorporated into printers, mechanical or electrical dispensers, manual dispensers and automation or robotic devices.

The polymeric tape 1 may have various layers, all of which may extend from end to end of the polymeric tape 1. Facestock 2 is the surface that can accept ink or printing, although the capability of accepting ink is not a requirement. The facestock 2 may already have data thereon, including a logo (e.g., repeated along the length of the tape), graphic, image, etc. This may include printing using a thermal printer, a thermal-transfer printer, a direct-thermal printer, a laser printer, an inkjet printer, LED printer, UV printer, impact printer, dot-matrix printer, laser-etching printer, flexographic printer, offset printer or a printing press or any other type of printer or device capable of delivering ink on any of the surfaces of the tape. The facestock itself may include one or more layers, including transparent and opaque layers, shielding layer(s), top coating(s), ink(s), varnishes, lamination(s), wireless communication capabilities such as RFID (Radio Frequency Identification), NFC (Near Field Communication), Bluetooth, WiFi and other types of wireless communication tags or a chip, sensor, electronic component, etc. The polymeric tape 1 can be provided blank or printed with any background color or color indicator such as thermochromic ink, and/or image, and/or information and/or barcode and/or alphanumeric markings, and/or indicia etc. The facestock materials can be made of a polymer. The facestock material(s) may include but are not limited to polymers such as polypropylene, biaxially oriented polypropylene (BOPP), polyester (PET), polystyrene, vinyl including polyvinyl chloride (PVC) and polyvinyl fluoride (PVF), acrylate, nylon, polyamide, satin, polyolefin, polyethylene, polyimide, tyvek, composite materials, silicone, silicone rubber, rubber, synthetic rubber, latex, thermoplastic films, thermoset plastics, plastic extrusion materials, and may also include cloth tissues, woven or non-woven fabrics, foam, graphene, magnetic film, carbon-enforced metallic foils such as aluminum foil, Velcro, degradable and soluble materials including biodegradable, compostable and recyclable materials or any combination thereof. The facestock materials include paper and polymer composites or combinations, cloth and polymer composites, including nano-composite materials or combinations thereof, including layers of polymer and paper and/or cloth, such that the paper or cloth is for example laminated with plastic. The tape 1 may be tamper evident and/or destructible tape, "destructible" meaning that the tape can break into pieces or fragments upon attempt to remove it from the substrate to which it has been adhered. Some tamper evident features might include specific cuts and/or perforations within the facestock at specific locations making it fragile and causing tape rupture upon attempts to remove it after applying the adhesive tape to a substrate or a container. There are other types of tamper evident materials that can reveal the tampering and the tape 1 may be made from such materials. In an embodiment, the microcuts created by the below described tooling alone may be used as a tamper-evident feature of the tape 1. Embossed materials, stamped foil, 3-dimensional formatting and other modified facestocks can be used as a facestock for the tape 1, Clear, opaque, transparent, translucent, hazy, and/or reflective materials or any combination thereof may also be used for the facestock. The polymers may be thermoplastics or thermosoftening plastics, i.e., plastic polymers that soften or become moldable when heated to a certain threshold temperatures, to solidify upon cooling. The polymers may be thermoset plastics comprising cross-linked polymers to form an irreversible chemical bond and may become non-moldable when heated. The facestock may be selected to have direct thermal printing capacity meaning that ink is incorporated inside the facestock or in its top coating. The ink may then be released upon heating the facestock layer such as by a thermal printer or a heat-emitting or heated instrument. The facestock may be for example printed with a reversible or a non-reversible thermochromic ink which may also be incorporated inside the facestock or other constituent of the tape such as inside the lamination or inside the polymer or inside the adhesive. The use of a combination of printing methods is contemplated. All tapes of the present disclosure may or may not accept writing by a pen, pencil, marker or any other instrument for manual writing. The tapes may be configured for skin contact as well, for instance in medical uses such as a transdermal patch containing a medication. The tapes described herein may be cloth tape, non-adhesive demarcation tape, nano tape, PTFE tape (polytetrafluoroethylene), among examples.

An adhesive layer 3 may be coated on the underside of the facestock 2. A first support liner or release liner 4 may also be provided, from which the adhesive layer 3 with the facestock 2 can be released. In another embodiment, the polymeric tape 1 may be linerless and wound on itself, such that the adhesive layer 3 harbors or releasably adheres to the top surface of the facestock 2 from which it can be released. In the latter case the surface of the facestock 2 may have non-stick characteristics allowing the adhesive 3 of a top layer of the tape 1 to be released from facestock 2 of the underlayer of the tape 1 and remain associated with the underside of facestock 2. It is pointed out that the devices and tooling described herein may be employed against part of the polymeric tape prior to the addition of other layers. For example, the devices and tooling may be used against the facestock 2, before or after an adhesive layer 3/liner 4 is present. The release liner 4 may be paper based, or polymer based, with contemplated polymers including a polyester (PET), polypropylene, bi-axially oriented polypropylene (BOPP) or any other type of a polymer or thermoplastic film. For example, the release liner 4 may be a silicone or fluorosilicone coated support on which the adhesive layer 3 is harboured or retained, though other materials can be used, including waxes or other adhesive release coatings, etc, on a substrate. For example, if the support liner 4 is paper based, a low friction coating may be present to facilitate the peeling off of the facestock 2 and adhesive layer 3 from the support liner 4. Accordingly, when the release liner 4 is removed, the facestock 2 may be adhered to a surface, by the adhesive layer 3. In an embodiment, the facestock 2 is a static cling film and/or relies on static cling as an alternative to having the adhesive layer 3. In an embodiment, the static cling tape may only have facestock 2, at least one of the surfaces of the facestock 2 having the capacity of clinging to the at least one surface of another portion of the facestock 2 via static cling force, for example when the facestock 2 of tape 1 is rolled onto itself in a roll. In another embodiment, the static cling tape includes the facestock 2 on a support liner 4. In another embodiment the facestock 2 is an adhesive free wrapping tape such as a stretchable wrap. In another embodiment the facestock 2 is an adhesive free silicone-rubber tape as described in the U.S. Pat. No. 10,577,138, the content of which is incorporated herein in its entirety. In another embodiment, the release liner 4 may have imaging properties meaning that the manual writing with a pen or a pencil or with any type of impact instrument or impact printer can create a copy of the image on the release liner 4. In this case, when the facestock 2 is removed from the liner 4, the copy of the printed information or the image remains on the release liner 4 similar to carbon-copying. In another embodiment, if the tape 1 has a paper facestock 2 and a polymeric release liner 4, the polymeric liner 4 will prevent the clean tearing of the tape 1, whereby tear cuts or micro tear cuts 5, as described below into the liner 4 will facilitate the tearing. In FIG. 13, the liner 4 is shown having the same width W1 as the facestock 2 and as the adhesive layer 3, but may have a width that is greater than the width of the facestock 2 and the adhesive 3 (adhesive coated facestock) such that the liner 4 extends beyond the facestock 2 widthwise, at one edge of the facestock 2, or at both edges of the facestock 2. By way of example, the polymeric tape 1 may have a width of at least 4.0 mm. In an embodiment, the dimension is 12 mm±6 mm. In another embodiment the dimension is 19 mm±9 mm. In another embodiment the dimension is between 25 mm and 70 mm. In another embodiment the dimension is between 70 mm and 110 mm. In another embodiment, the width of the tape is between 100 mm and 220 mm. These dimensions are given as examples. Moreover, while FIG. 13 shows the tear cuts 5 extending through the facestock 2, in an alternate embodiment, item 5 may be a nick that penetrates the top surface of the facestock 2, but that does not extend from face to bottom of the facestock 2. Such nicks are weaknesses or partial penetration in the material of the facestock 2, to facilitate the tearing of a strip of the facestock 2. As yet another possibility, while FIG. 13 shows the tear cuts 5 extending through the facestock 2 and the support liner 4 (if present), in an alternate embodiment, the tear cuts 5 do not penetrate the support liner 4. As another embodiment the support liner 4 of the FIG. 13 may be wider (W) than the facestock 2 on one or both sides of the tape widthwise. As another embodiment the support liner 4 of the FIG. 13 may be narrower than facestock 2 on one or both sides of the tape widthwise.

Still referring to FIG. 13, the polymeric tape 1 is shown at least partially lengthwise, as extending in direction L. Only a segment of the polymeric tape 1 is shown, as the polymeric tape 1 may extend far longer in the direction L. The polymeric tape 1 is shown as having micro tear cuts 5 transverse to the longitudinal (i.e., lengthwise) dimension of the polymeric tape 1, and this may be referred to as a widthwise direction, for example as shown by W1. The expression "micro" is used to indicate that the tear cuts are small (i.e., may have a small penetration length) to the point that they may not even be visible. For example, the penetration of the cuts in the facestock 2 may be in the micro scale, and may be as low as 0.001 mm, and may not exceed 2.0 mm (i.e., 0.001 mm to 2.0 mm). However, the tear cuts 5 may have a depth of penetration exceeding the micro-scale. Accordingly, the expressions "micro tear cuts" and "tear cuts" will be used interchangeably herein. The micro tear cuts 5 start from one or both of the elongated edges of the polymeric tape 1 and extend into the facestock 2 and/or the support liner 4, i.e., the penetration. Penetration refers to the length of the tear cuts 5 from the edge of the tape 1 or liner 4. In an embodiment, the penetration is from 0.001 mm to 3.5 mm, but may be up to 10.00 mm for example. In an embodiment, a paper support liner may not have tear cuts and the tear cuts 5 are only in the facestock 2. Other penetration lengths are contemplated, and may be as a function of the width of the tape 1. It is contemplated that the penetration could be less than 0.001 mm provided suitable technology enables such penetration. The micro tear cuts 5 into support liner 4 can be significantly longer and cover the entire width of the exposed support liner 4 in instances featuring a wider support liner 4. The micro tear cuts 5 do not extend from edge to edge of the facestock 2 of the polymeric tape 1, with the micro tear cuts 5 extending inwardly enough to reach the facestock 2 and penetrate it, if the facestock 2 is offset from the edge of the tape 1. In an embodiment, the polymeric tape 1 is a double sided tape (adhesive coated on both sides of the facestock 2) having i) one support liner 4 in which case it may have the release coating on both sides of the support liner 4, or ii) more than one support liner 4 in which case the facestock 2 is sandwiched between two support liners 4. As another embodiment, the tape 1 is a piggy back construction having an additional support liner 4 beneath the main support liner 4, as described in as described in U.S. Pat. No. 11,319,464. In another embodiment, the tape 1 is a transfer tape meaning that the adhesive is trapped between two liners 4, i.e., a main liner and a waste liner, and there is no facestock in the tape 1. The transfer tape is used for removing one of the liners 4 (waste liner) and applying a facestock such as facestock 2 or a similar one to the adhesive remaining on the main liner to create customized combinations of the desired facestock with the adhesive. The tear cuts 5 may be in both liners of the transfer tape. Transfer tape may also function with only one liner which has a release coating on both sides of the liner, such that the transfer tape may be wound in a roll. The tools described herein are configured to perform transverse cuts and slits in single sided tape, double sided tape and transfer tape (i.e., in the support liner(s) of the transfer tape).

Now that an exemplary configuration of the polymeric tape 1 is shown, with other configurations detailed in U.S. Pat. No. 11,319,464, devices and tooling that may be used to perform the tear cuts 5 in the facestock 2 are described.

Figure 1A:
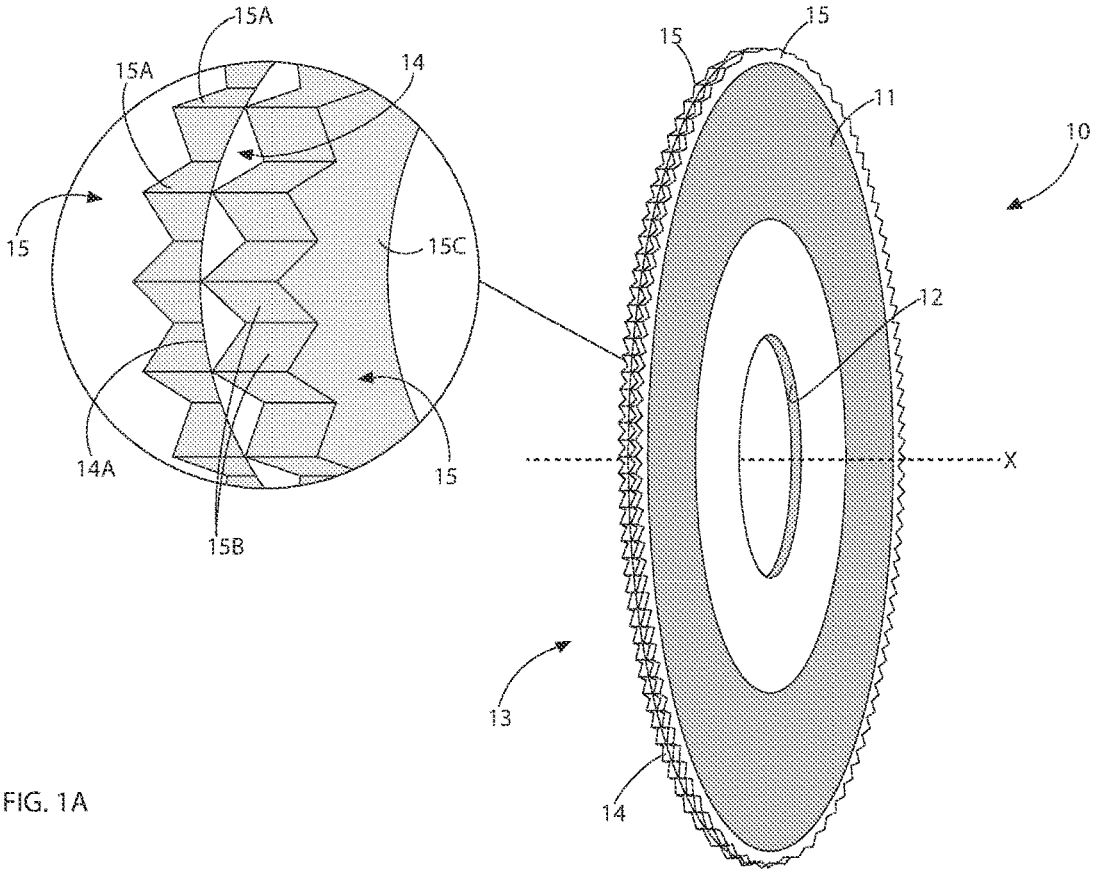
FIGS. 1A and 1B are perspective views of a slitter device in accordance with variants of the present disclosure.
Figure 1B:
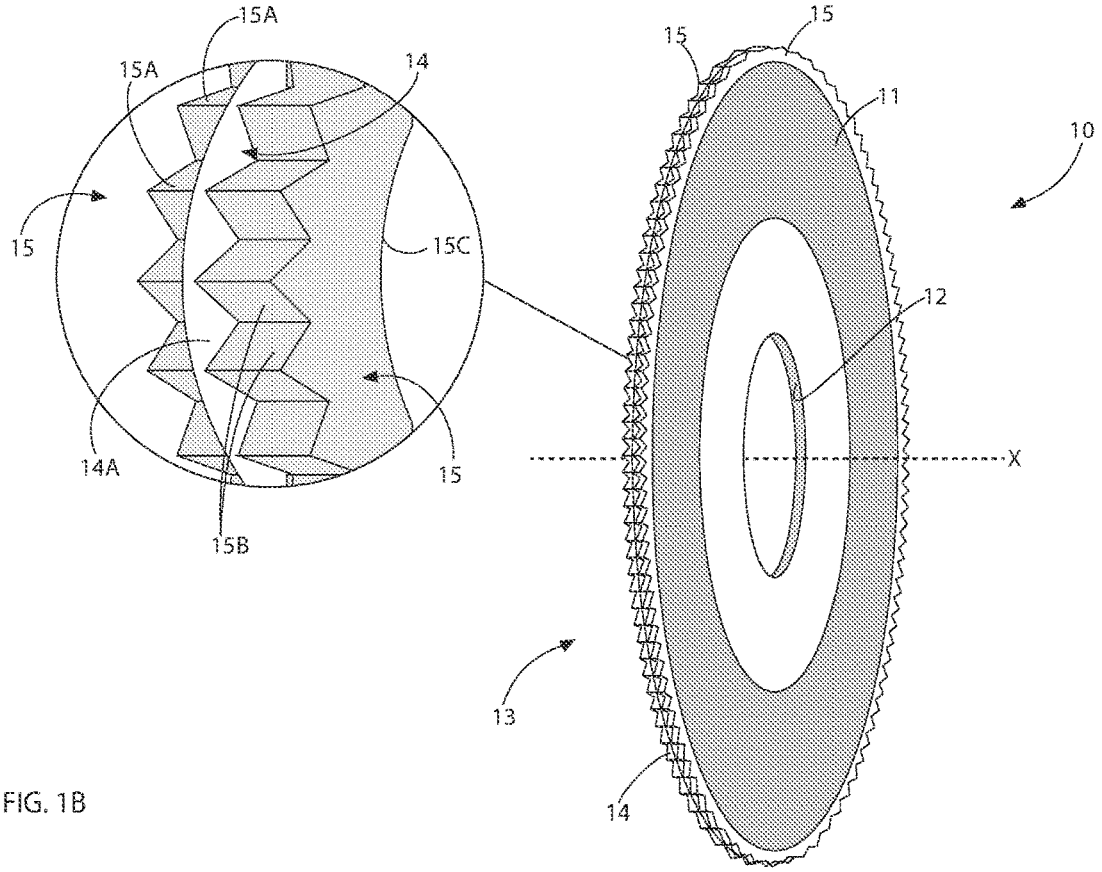

Referring to the drawings and more particularly to FIGS. 1A and 1B, there is shown a slitting device 10 in accordance with a variant of the present disclosure. While the expression device is used herein, item 10 may also be referred to as a slitting blade, roller cutter, rotary knife, shear knife, knife assembly, roller cutter device, tool, as tooling, as a knife, as a cutter, among numerous potential names. In a variant, the slitting device 10 is of the type that may be used in a slitter-rewinder apparatus, that may also be known as a slitter rewinder, as a slitter, tape slitter, tape slitter-rewinder, rewinder, among numerous potential names. A slitter rewinder apparatus may be generally described as a machine dedicated to cutting a master roll of material into rolls of smaller width, with the capacity of winding the smaller width material into rolls. Accordingly, the slitter rewinder apparatus may have an unwind shaft (a.k.a., roller, spindle) for the unwinding of a master roll of the material, for slitting it into strips of smaller width material and rewinding the strips of smaller width material on a rewind shaft(s) (a.k.a, roller, spindle), with the tooling used to slit the material of the master roll into the strips or rolls of smaller width material. The tooling is located on the path of the material travelling from unwind to rewind or situated between the unwind shaft supporting the master roll, and rewind shaft(s) supporting the smaller width roll, "between" being related to a sequence in the slitting-rewinding actions and not necessary to a physical location of components. Optionally, some slitter-rewinder equipment may allow reverse travelling of the material meaning the rewind shaft may act in an unwinding function, and the unwind shaft may function as a rewinding shaft. In an embodiment, the slitter-rewinder may have a duplex rewinding capability meaning that the slitted rolls may be rewinded on two separate shafts e.g., the odd slitted rolls (e.g., 1, 3, 5, 7, etc) are rewinded on one shaft and even rolls (e.g., 2, 4, 6, 8 . . . ) are rewinded on the second shaft. Therefore, rewinding on more than one shaft is contemplated. In another embodiment, the unwinding shaft(s) and/or rewinding shaft(s) may use a turret configuration, i.e., the slitter-rewinder may be able to complete a roll change in a continuous mode without stopping or reducing the number of stoppages of the slitter-rewinder apparatus, including for unwinding and rewinding. A turret configuration may have more than two rewind or unwind shafts. Other components may non-exhaustively include tensions control devices and components, tensioner rollers, nip rolls, motorization, motorized unwind, transmission, laser indicators for positioning the slitting knives (a.k.a., roller cutter, slitting device), manual positioning device(s) for positioning the slitting knives, trimming device(s), plasma coated rollers and/or other coated or low adherence rollers to prevent adhesive of the material from sticking to the rollers or to the knives. In some cases the shafts and/or rollers may have an anti-adhesion tape covering or applied over the rollers to avoid adhesive sticking to the rollers, etc. Slitting knives may also have a special coating or treatment to deter adhesive build-up on the blades of the knives and/or make them more durable and/or long-lasting. Often slitting knives, such as those described herein, are accommodated partly or completely inside a knife support assembly that is positioned on a shaft or like support structure (e.g., a slide bar), and the knife is operated in rotation using compressed air input into the knife assembly. The knife support assemblies may be referred to commercially as knifeholders (i.e., knife holders) or knife assemblies.

Figure 14:
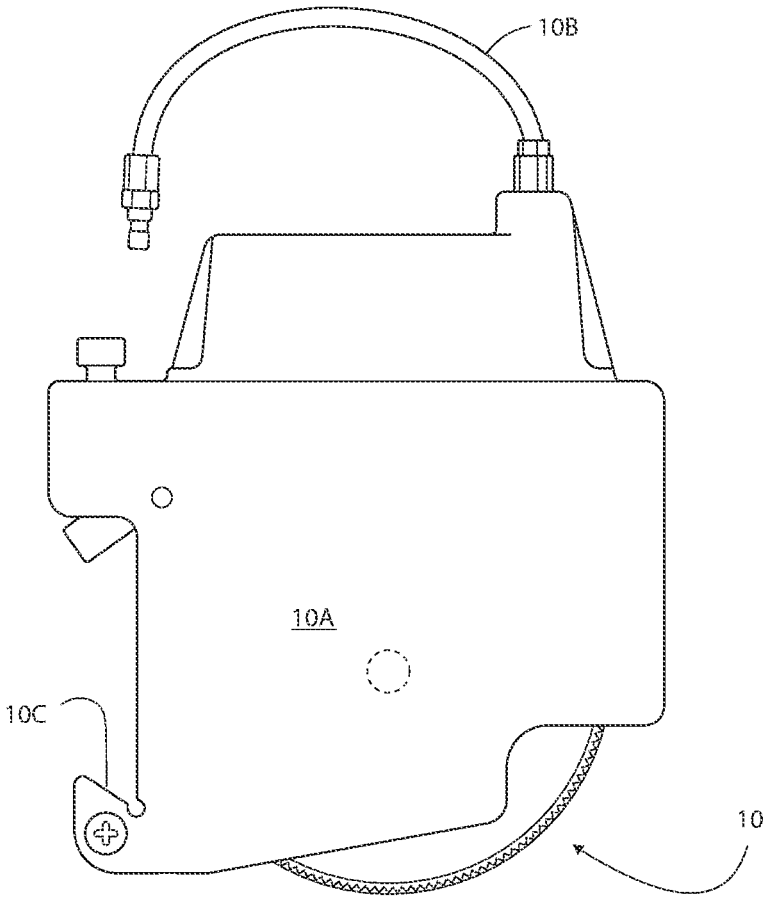
FIG. 14 is an assembly of a knifeholder and slitter device of the present disclosure.

The slitting device 10 has a disk body 11, as an option. As an alternative, or as a different to describe a disk body, the structure of the slitting device 10 may include a hub with spokes. The disk body 11 is rotatable about a central axis X when mounted to a roller or shaft. For example, the disk body 11 may have propeller means (e.g., fins, vanes, etc) for the rotation of the disk body 11 to be actuated, such as by compressed air (e.g., in a knife support assembly as mentioned above). The disk body 11 may alternatively have a pulley portion, a gear, or any other transmission component for actuation motion to be imparted to the disk body 11. The central axis X, or more precisely a vector, is normal to a radial plane of the disk body 11. The disk body 11 may optionally have a central bore 12, that may be concentrically positioned related to the central axis X. The central bore 12 may be of various sizes and is configured to be mounted to a roller or a shaft or a guide bar of an apparatus such as a slitter-rewinder apparatus, so as to rotate with the roller or the shaft. The slitting device 10 may be incorporated inside a casing or enclosure depending on the type of the slitting/rewinding equipment (e.g., part of the knife support assembly described above), and may thus be part of an assembly including such knife holder (a.k.a., knifeholder) such as a pneumatic knife holder including a score cut knife holder, a shear cut knife holder (for a male and female circular knives to create a rotating "scissor" effect on the incoming web, the female knives may for example be shaft mounted and the male knives may be in individual holders or shaft mounted), a half-cut pneumatic knife holder, a hot-cut pneumatic knife holder), casing, shield, enclosure possibly requiring a compressed air connection. Indeed, in a variant, the slitting device 10 is part of a casing that uses compressed air as motive force, with the slitting device 10 being driven in rotation by the compressor air. For example, the casing may be a holder by Carolina Knife & Manufacturing (Asheville, NC, USA), Burris Machine Company (Hickory, NC, USA), Dienes USA (Spencer, MA, USA). FIG. 14 shows an exemplary casing 10A supporting a slitting device 10, the slitting device 10 in the casing 10A being in accordance with variants described in FIGS. 1A to 5B. The casing 10A defines an inner cavity accommodating a substantial part of the slitting device 10, though with the slitting device 10 exposed to performs its slitting/cutting work. The casing 10A may have a shaft or shaft support, or any appropriate configuration for rotatingly support the slitting device 10, such that the slitting device 10 may rotate about itself. Tubing 10B is shown so as to provide compressed air to actuate a rotation of the slitting device 10. For example, tubing 10B is in fluid communication with a pneumatic motor that is engaged with the shaft to actuate a rotation of the slitting device 10. However, other actuation means can be present, including a motor, a transmission (e.g., pulley/belt, sprocket/chain), magnetic actuation, hydraulics, etc. A connector 100 may be present for the knifeholder to be secured to structure, such as a rail, etc. The illustrated connector 100 is one among others. The same casing 10A may be used with replacement slitting devices 10, such that the slitting devices 10 may be sold separately. It is also contemplated to render a plurality of slitting devices 10 (e.g., some of different sizes) with a single casing 10A.

The dimension of the central bore 12 may be as a function of a dimension of the roller or like rotating component to which the slitting device 10 will be mounted. The central bore 12 is shown as having a smooth inner circumference, but may have different surface features to enable the roller cutter device to roll with its support member. For example, the central bore 12 could be provided with spline formations, a keyway, threading, press fit, and/or locking collar(s), among possible surface features. The slitting device 10 may be a monoblock component of the shaft as another possibility with one or more slitting devices 10 being on the shaft. Any appropriate configuration or mechanical member may be provided to rotatably fix the slitting device 10 on its support member, if concurrent rotation is required. In an alternative embodiment, the slitting device 10 is interfaced to a shaft or like support member by a bearing(s). The slitting device 10 could then rotate relative to the shaft or like support member, in a idler-style configuration. The slitting device 10 may also be connected to a compressed air source (via a casing) and/or a transmission and may include a pulley, a gear, etc, for example projecting from a side surface of the disk body 11. A laser cutting technology using a laser beam such as CO 2 laser cutter for cutting/slitting the tape material instead of or in conjunction with the slitting device 10 is contemplated.

The slitting device 10 further includes an outer circumference 13. The outer circumference 13 is the portion of the roller cutter device 12 that is oriented radially outwardly. The outer circumference 13 is the part of the slitting device 10 that comes into contact with polymeric film on adhesive side or non-adhesive side in a slitter-rewinder apparatus, for example. In a variant, a circular blade 14 projects radially from the disk body 11 to define a portion of the outer circumference 13. The circular blade 14 therefore has a cutting edge 14A at its radialmost edge. The circular blade 14 may for example have a circular shape and may be concentrically aligned with the central axis X such that film that moved relative to the slitting device 10 has an elongated straight cut as a result of contact with the circular blade 14. The circular blade 14 is typically made of a hard material, such as metals including treated metals, though other materials such as ceramic may be used. For example, the circular blade 14 may be as commercially available from multiple sources e.g. Portage Knife Company (Akron, OH, USA) part #W0875-60-000, 0875-60-000, 125-40-000, 125-40-000-201, 125-40-000-D2, 125-40-0015, 127-56-000, 137-10-0025-D2, 137-20-0025-D2, 180-45-006, 190-60, 193-60-1.75, 190-25/70-005, 195-60, 300-00-041, and various other models, variations and designs.

In the variant of FIGS. 1A and 1B, two rows of transverse blades 15 are on opposite sides of the circular blade 14. The transverse blades 15 are oriented in such a way that cutting edges 15A of the blades 15 are transverse to the cutting edge 14A of the circular blade 14, such that the blades 15, and other similar transverse blades described herein, are responsible for penetrating the polymeric film transversely to the longitudinal slit, and concurrently with the longitudinal slitting. As shown in FIG. 1B, the circular blade 14 may be not be at the same level as the cutting edges 15A of the traverse blades 15. The circular blade 14 may be extending beyond the level of the cutting edges 15A of the traverse blades 15 which will result it cutting/slitting through the tape material by the circular blade 14, whereas the traverse blades 15 make incomplete cuts of the facestock causing weakening of the material, resulting in an easier tearing of the slitted tape. In an embodiment, the cutting edges 15A intersect the cutting edge 14A in a cylindrical plane, defining + shapes. In an embodiment, a plane of each blade 15 is perpendicular to a plane of the circular blade 14, although is some configurations the blades 15 may not be in this perpendicular relation with the circular blade 14, for instance by having some non-perpendicular angular positioning relative to the circular blade 14. As observed in FIGS. 1A and 1B, the cutting edges 15A of the rows of transverse blades 15 on opposite sides of the circular blade 14 are aligned. However, it is contemplated to have blades 15 on opposite sides of the circular blade 14 in an offset arrangement as well. In an embodiment, with reference to FIG. 5C, the transverse blades 15 may not be symmetrical and may have different length(s) compared to the transverse blades 15 on the opposite side of the circular blade 14, such as shown by L1 and L2. FIG. 5C also depicts the circular blade 14 as having a tapering tip, akin a triangular prism. The configuration of the circular blade 14 of FIG. 5C may be used with any embodiment of the slitting device 10 described herein.

In another embodiment, the transverse blades 15 may not be symmetrical and may have different shape and/or stepping compared to the transverse blades 15 on the opposite side of the circular blade 14, stepping being the spacing of the transverse blades 15 along the circumference of the circular blade 14. Although FIGS. 1A-4B, and FIGS. 6-10 show that all transverse blades 15 are identical in the same slitting device 10, it is contemplated that one or more transverse blades 15 may have a different configuration, dimensions, and characteristics. For example, one or more of the transverse blades 15 may be wider than others, or for example have a different angular positioning, or one or more of the transverse blades 15 may have a different stepping, or one or more transverse blades may be absent at certain locations along the circular blade 14 resulting an uncut area at certain position or a different shape of a cut at a specific area.

In a variant, still as shown in FIGS. 1A and 1B, the cutting edges 15A are at a peak of triangular prisms 15B, or of like pyramid or tapering formation. Triangular prisms 15B are mounted to an annular base 15C. For example, the triangular prisms 15B may be integrally formed with the annular base 15C. Therefore, the annular base 15C provides some structural support considering that the peaks of the triangular prisms 15B will come in contact with the polymeric film of the tape and will therefore be subjected to forces. The arrangement shown in FIGS. 1A and 1B is one among others, with further examples provided below. In a variant, the cutting edges 15A are parallel to the central axis X (i.e., each cutting edge 15A lying in a common plane with the central axis X). It is however considered not to have them parallel to the central axis X, or to only have some of the cutting edges 15A parallel to the central axis X.

Figure 2A:
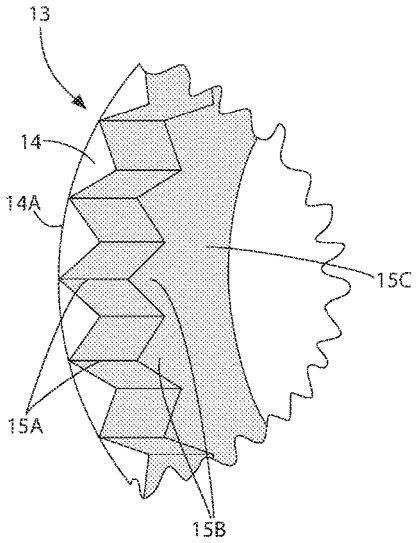
FIGS. 2A and 2B are enlarged views of a row of transverse blade edges that may be part of the slitter device of FIGS. 1A and 1B, respectively.
Figure 2B:
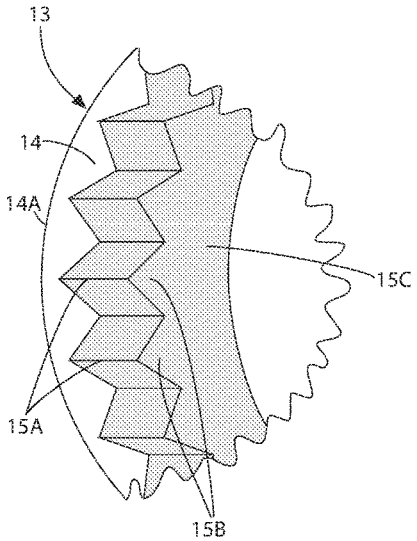

While the slitting device 10 of FIGS. 1A and 1B would be used to slit a larger film from a master roll in two portions of film each having transverse cuts (mirrored with respect to one another), it is also possible to have a configuration by which there is only one row of transverse blades 15 as shown in FIGS. 2A and 2B. Such arrangement may be present in a slitting device 10 that is used at or near an edge of a master film. Other than for the absence of a second row of transverse blades 15, the embodiment of FIGS. 2A and 2B are similar to that of FIGS. 1A and 1B. The embodiments of FIGS. 2A and 2B differ from one another, in that the cutting edge 14A of the circular blade 14 extends beyond the cutting edges 15A of the transverse blades 15.

Figure 3A:
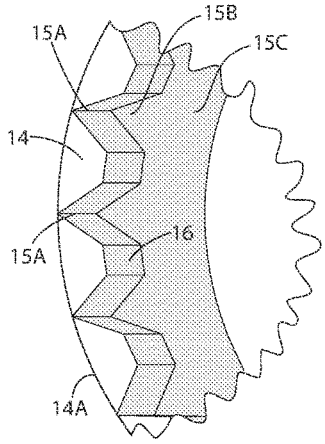
FIGS. 3A and 3B are enlarged views of a row of transverse blade edges that may be part of the slitter device of FIGS. 1A and 1B, respectively.
Figure 3B:
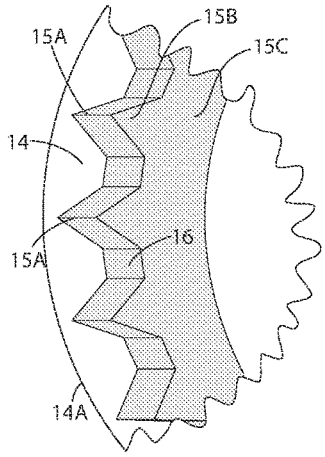

Referring to FIGS. 3A and 3B, a similar configuration is shown in which triangular prisms 15B are present. However, flats 16 may be provided between the triangular prisms 15B, to space apart the transverse blades 15. Although the expression "flat" is used, the flat 16 may not be perfectly flat and may be a circumference of the annular base 15*c*. Other configurations are contemplated, notably with filets present between the triangular prisms 15B and the flats 16, of between the triangular prisms 15B in the absence of flats 16. Moreover, while a single row of blades 15 is shown in FIGS. 3A and 3B, a second row could be provided in the manner shown in FIGS. 1A and 1B. The embodiments of FIGS. 3A and 3B differ from one another, in that the cutting edge 14A of the circular blade 14 extends beyond the cutting edges 15A of the transverse blades 15.

Figure 4A:
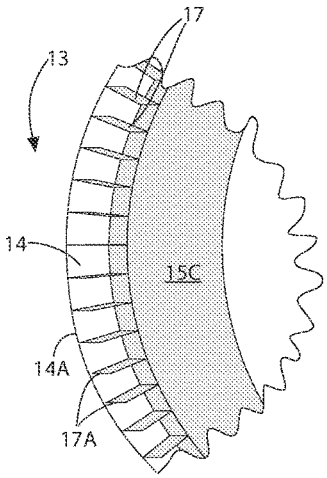
FIGS. 4A and 4B are enlarged views of a row of transverse blade edges that may be part of the slitter device of FIGS. 1A and 1B, respectively.
Figure 4B:
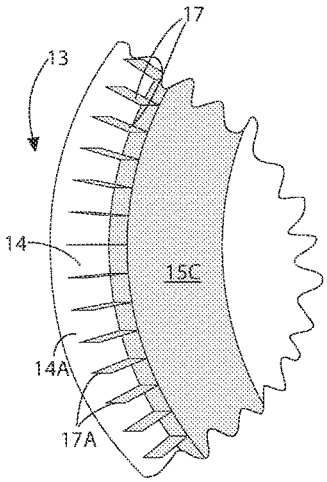

Referring now to FIGS. 4A and 4B, another schematic variant is shown in which fin blades 17 project from the annular base 15C, the fin blades 17 being transverse blades enabling the generation of tear cuts in a similar way as for the transverse blades 15 of FIGS. 1A-3B. Again, a single row of blades 16 is shown but a pair of rows of the fin blades 17 could be provided in the manner shown in FIGS. 1A and 1B. In a variant, the blades 17 are made of a rigid material, such as a metal, though other materials could be used. The blades 17 have blade edges 17A that may be sharpened to penetrate the polymeric material of the film concurrently with the slitting action. The embodiments of FIGS. 4A and 4B differ from one another, in that the cutting edge 14A of the circular blade 14 extends beyond the cutting edges 17A of the fin blades 17. The graphics of the fin blades shown in the FIGS. 4A and 4B are illustrative only, as the fin blades 17 may be of different thickness. Moreover, the blade edges 17A may be flat, sharp, rounded or in any other shape or form to provide the weakening of the tape facestock and facilitate cutting. Referring to FIGS. 1A-4B any combination of the depicted or similar configurations or variants thereof is contemplated.

Figure 5A:
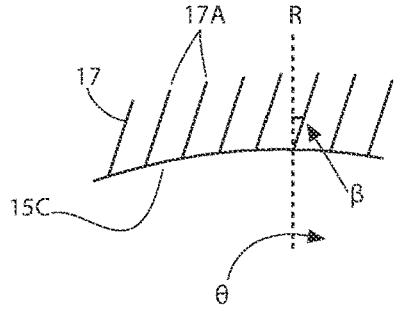
FIG. 5A is a schematic view showing a potential orientation of fin blades of the row of transverse blades of FIG. 4.
Figure 5B:
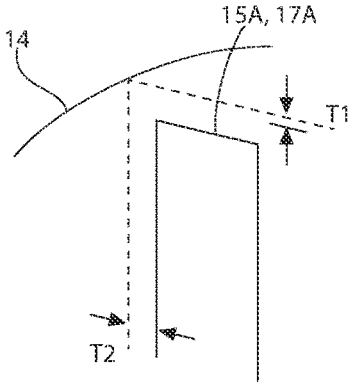
FIG. 5B is a schematic view showing transverse blade edges inward or offset from the circular blade in a variant of the slitter device of FIG. 1.
Figure 5C:
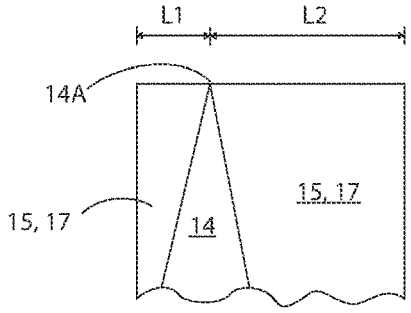
FIG. 5C is a schematic view showing transverse blades having different lengths on opposite sides of the circular blade in a variant of the slitter device of FIG. 1.

Referring to FIG. 5A, the fin blades 17 are shown projecting at an angle β. The angle β can be described as being between a plane of the fin blade 17 to a projection of the radius R of the slitting device 10, at an intersection between the fin blade 17 and the annular base 15C. In an embodiment, angle β may approximate from 0 degrees to 45 degrees in either direction, in a direction of rotation that is shown as θ in FIG. 5A. Depending of the outer diameter of the Angle β can have more fluctuation. Other configurations of a transverse knife or a blade contacting or in immediate proximity to circular blade 14 and/or cutting edge 14A with or without the annular base 15C is contemplated. The configuration of the transverse blade 15, 15A or 17 may be not just a straight line but it can be a needle-shape, micro size circle, microsize semi-circle, triangle, oval, semi-oval, zig-zag, solenoid or any other geometrical shape or irregular shape, and may be symmetrical or non-symmetrical or any combination thereof under any angle that can create cuts into the tape material penetrating through the entire depth of the material thickness (a.k.a. metal-to-metal) or penetrating the material to a depth without fully cutting through the material (e.g., to create a nick) but to a degree sufficient to allow the initiation of tearing. In an embodiment, with respect to FIG. 5B, the edges of the transverse blades 15A, 17A may be at the same level as the edge 14A of the circular blade 14. Stated differently, T1 may equal zero or be around 0. In another embodiment, the edges of the transverse blades 15A, 17A may be slightly radially inward of the slitting edge 14A of the circular blade 14, i.e., T1>0. For instance, the relation T1>0 may be present when it is desired to make a micro-cut only in the facestock 2 (FIG. 13) and not in the support liner 4, while the elongated slit of the slitting edge 14A cuts through the facestock 2 and support liner 4. The relation T1>0 may also be present if the support liner 4 is paper-based or if there is a need to make incomplete penetrations of the facestock 2, such as a nick as described above, whether in the case of a self-wound tape or a tape 1 with a liner 4. In an embodiment, T1 is equal to a thickness of the support liner 4 or may be anywhere between around 0 and the thickness of the support liner 4, or anywhere between around 0 and the thickness of other components in cases of multilayer structure materials. Stated differently, T1 may be chosen so as to cause a cutting of selected layers of tape 1 and/or to cause a desired depth of penetration in the tape 1. Any value of T1 permitting slitting of the tape using slitting edge 14A is contemplated. FIGS. 1B, 2B, 3B, and 4B are all examples of slitting devices 10 complying with the relation T1>0. Moreover, there may be a distance T2 between the edge 14A of the circular blade 14 and the edge of the transverse blades 15A, 17A, though previous embodiments shown T2 equals zero. The blades described herein (e.g., 14, 15, 17) may have a lubrication or coating applied them to avoid adhesive build-up on the blades in case the blades slit a tape having its adhesive side facing the blades. Such lubrication or coating helps avoiding or reducing adhesive buildup. In a variant, the blades are coated by saturating felt pads periodically with light oil, or substances such WD-40 or other lubricants, with a lubricator attachment being part of the knifeholder, or in any appropriate operative contact with the blades. One contemplated lubricator attachment is commercially available from suppliers such as Burris Machine Company (Hickory, NC, USA). If the adhesive is facing down towards the base roller or anvil in a slitter-rewinder or any other apparatus, then the base roller may be coated with an anti-stick coating (e.g., plasma coated rollers or other types of coating), an anti-stick specialty tape or equivalent.

The slitting device 10 described in any of FIGS. 1A to 5B may be used in score slitting or crush cutting. Score slitting/crush cutting involve the user of a rotating knife pressed against a hardened roller, sometimes referred to as an anvil roll or crush roll.

Figure 6:
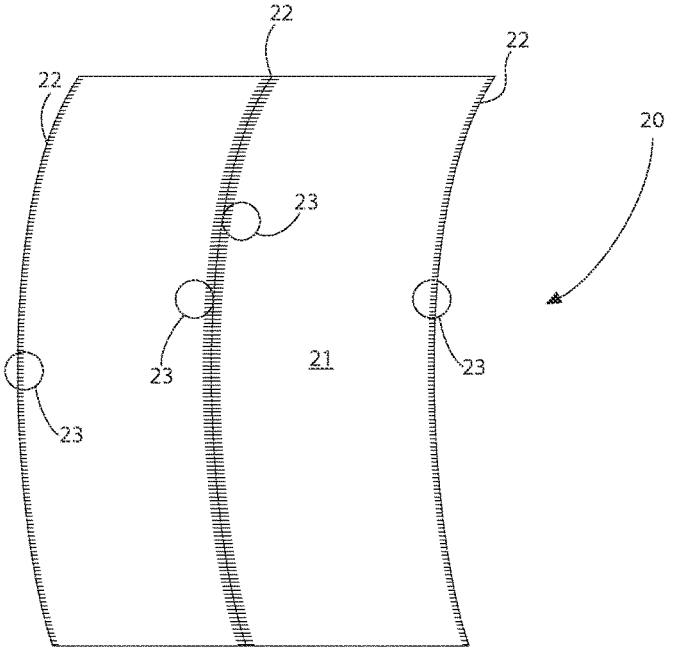
FIG. 6 is a prospective view of a cutting die device in accordance with another variant of the present disclosure.
Figure 7:
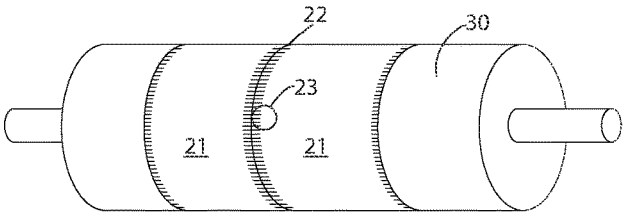
FIG. 7 is a perspective view showing the cutting die device of FIG. 6 mounted to a roller.
Figure 8:
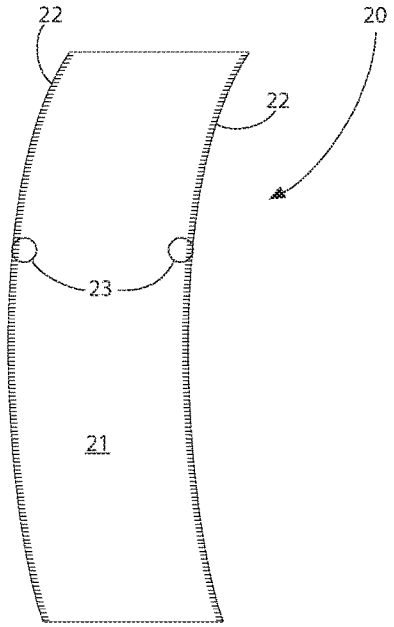
FIG. 8 is another perspective view of a cutting die device in accordance with another variant of the present disclosure.

Referring now to FIG. 6, a cutting die device 20 is shown. The cutting die device 20 is of the type that is used as a magnetic die used in rotary die-cutting equipment which can be integrated in various types of slitter-rewinders, printing, coating and laminating equipment such as flexographic, inkjet, UV inkjet, UV, LED UV, waterbased, solvent based, silicone based, hotmelt, UV hotmelt, acrylic hotmelt, laser, offset, digital, liquid eletrophotographic, screen printing, 3D printing, thermal-transfer, direct thermal, sublimation, lamination machines (including flexographic printer), etc. For example, a general type of flexible dies/magnetic dies are commercially available from a number of companies such as Apple Die (Milwaukee, WI, USA), Wilson Manufacturing Company (St-Louis, MO, USA), Spilker GmbH (Leopoldshohe/Germany), to name a few examples. When used as a magnetic die, the cutting die device 20 is mounted to a roller 30 as shown in FIG. 7, and retained thereon by magnetic forces. For example, the roller 30 may be referred to as a magnetic cylinder, magnetic die cylinder, cylinder for a flexible die. The magnetic cylinder 30 may be actuated to create a magnetic field that retains the cutting die device 20 thereon, the cutting die device 20 (a.k.a. flexible die, flexible magnetic die if used with magnetic attraction) being made for example of a ferromagnetic or ferrous material, or any other thin metal sheet that can be attracted and retained on the magnetic cylinder via magnetic force. The cutting die device 20 can be secured to the roller 30 in other ways, i.e., not only by magnetic forces. For example, the cutting die device 20 may be retained by an adhesive tape, sleeves, collars, fasteners, among numerous other ways. Magnetic cylinders 30 may have different diameters, such that the size of the cutting die device 20 is paired with the proper magnetic cylinder size. The same magnetic cylinder 30 can be used for different sizes of tapes and labels depending on the flexible dies, i.e., the cutting die devices 20 described below and shown in FIGS. 6 and 7. The label dimensions and the distance between the labels (gap). Another variant is to use a solid cylinder (non magnetic) which is engraved with the required pattern. Such a solid cylinder may be a monolithic tool that can be used only for slitting/cutting a singular pattern engraved on the cylinder 30. Another cutting/slitting technology includes laser cutters which use a laser beam to cut and slit tapes. The depth of the cut is mostly determined by the energy setting of the laser. The cutting die device 20 may be part of a flexographic printing press or equipment or machine or a die-cutting equipment. The cutting die device 20 may also be part of tape slitting equipment, a tape rewinding, a label rewinding equipment, or any other like equipment.

The cutting die device 20 has a plate body 21 that is curved to be mounted on the roller 30 as in FIG. 7. The plate body 21 may be ferrous or ferromagnetic, for instance if held by magnetic forces, but this is optional. The cutting die device 20 of FIG. 6 is of the type that is used to produce two separate rolls of polymeric tape with tear cuts, from a single master (e.g., master roll). The plate body 21 has a set of circumferential blade edges 22 (three shown) that will be used to cut the polymeric tape lengthwise. Rows of transverse blade edges are shown at 23, with a central one of the circumferential blade edges 22 having transverse blade edges 23 on opposite sides thereof, while the outer circumferential blade edges 22 only have inward transverse blade edges 23 (though alternative arrangements are possible). The transverse blade edges 23 may intersect the circumferential blade edges 22. Hence, the cutting die device 20 may be described as having a plate body 21 configured to be positioned on a cylindrical surface, such as that of roller 30, with circumferential blade edges 22 projecting from a plane of the plate body, the circumferential blade edges 22 configured to extend along a circumference of the cylindrical surface; and one or more rows of transverse blade edges 23 projecting from the plane of the plate body 21, the transverse blade edges 23 being oriented transversely relative to the circumferential blade edges 22. In an embodiment, the transverse blades 23 may not be symmetrical and may have different length(s) compared to the transverse blades 23 on the opposite side of the circumferential blade edges 22, in a similar configuration as in FIG. 5C. In another embodiment, the transverse blades 23 may not be symmetrical and may have different shape and/or stepping compared to the transverse blades 23 on the opposite side of the circular blade edges 22.

The blade edges 22 and 23 may be punched, cast, engraved, machined, 3D printed, CNC machined, etc onto the plate body 21. Accordingly, when the cutting die device 20 is mounted on the roller 30 as in FIG. 7 and film is passed between the roller 30 and another roller such as base roll (a.k.a. anvil), the blade edges 22 and 23 will concurrently perform cuts (a longitudinal slit and transverse cuts) that will result in the polymeric tape with tear cuts as in U.S. Pat. No. 11,319,464. In a variant, only the central one of the circumferential blade edges 22 has transverse blade edges 23, to produce a polymeric tape having only one edge with tear cuts. In an embodiment, all or a plurality of the circumferential blade edges 22 have transverse blade edges 23 on both sides of the blade 22 (e.g., with the exception of plate end blade edges 22). In an embodiment, on a same flexible die, it is possible to have more than one circumferential blade edges 22 with transverse blade edges 23 on both sides of the blade 22 which can result in a production of multiple rolls of tapes rewinded on a single shaft, dual shaft or multiple shaft device such as a turret. Other arrangements are possible as well.

Figure 9:
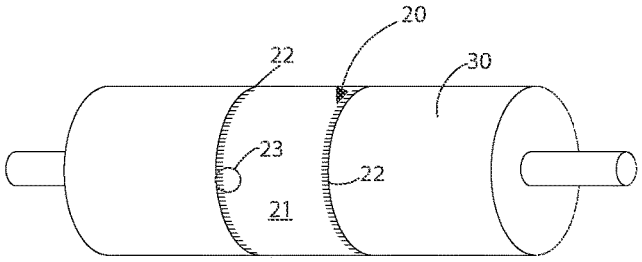
FIG. 9 is a perspective view of the cutting die device of FIG. 8 mounted to a roller.
Figure 10:
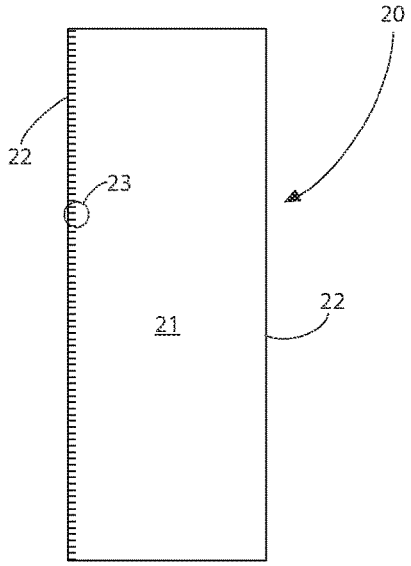
FIG. 10 is an elevation view of a cutting die device in accordance with another variant of the present disclosure.

FIG. 9 shows another cutting die device 20, but used to manufacture a single roll of tape, in contrast to the embodiment of FIGS. 6 and 7 that allows the preparation of a pair of rolls with tear cuts—or that could be scaled up to die-cut more than two rolls. Thus, it is contemplated to have a polymeric tape that has tear cuts only on one of its two lateral longitudinal edges. The cutting die device 20 of FIG. 10 may be used for such a task. The configuration of the transverse blades 23 may be not just a straight line but it can be a needle-shape, micro size circle, microsize semi-circle, triangle, oval, semi-oval, zig-zag, selenoid or any other geometrical shape under any angle that can create cuts into the tape material penetrating through part of or the entire depth of the material thickness (a.k.a. metal-to-metal). In an embodiment, the transverse blades 23 may be replaced by micro-dot shape pins, or needles. In another embodiment there may be any combination of the above mentioned shapes. As an embodiment the transverse blades 23 may be at the same level as the circumferential blade 22. As another embodiment the transverse blades 23 may be slightly beneath the slitting edge of the circumferential blade in the manner shown in FIG. 5B for the same reasons as described for FIG. 5B. Stated differently with combined reference to FIG. 5B and to the embodiments of the cutting die device 20, the approximate values of T10 and/or T20 may be used in the cutting die device 20, as required by the application. In another embodiment instead of using a magnetic die, it is contemplated to use of a solid die instead of a plate, the solid die being a single monolithic roll engraved with the circumferential blade 22 and transverse blades 23. The solid die once installed on die-cutting equipment, flexographic or other type of die-cutting equipment can function in a similar fashion as the magnetic die described above, producing similar product. A solid die may have greater durability but may be more expensive than thin sheet metal dies for magnetic cylinders.

Figure 11:
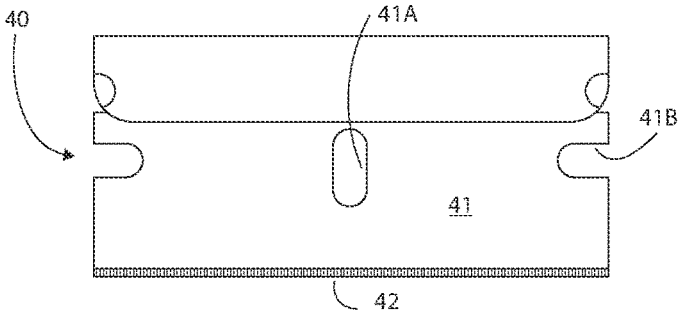
FIG. 11 is an elevation view of a cutting blade device in accordance with another variant of the present disclosure.
Figure 12:
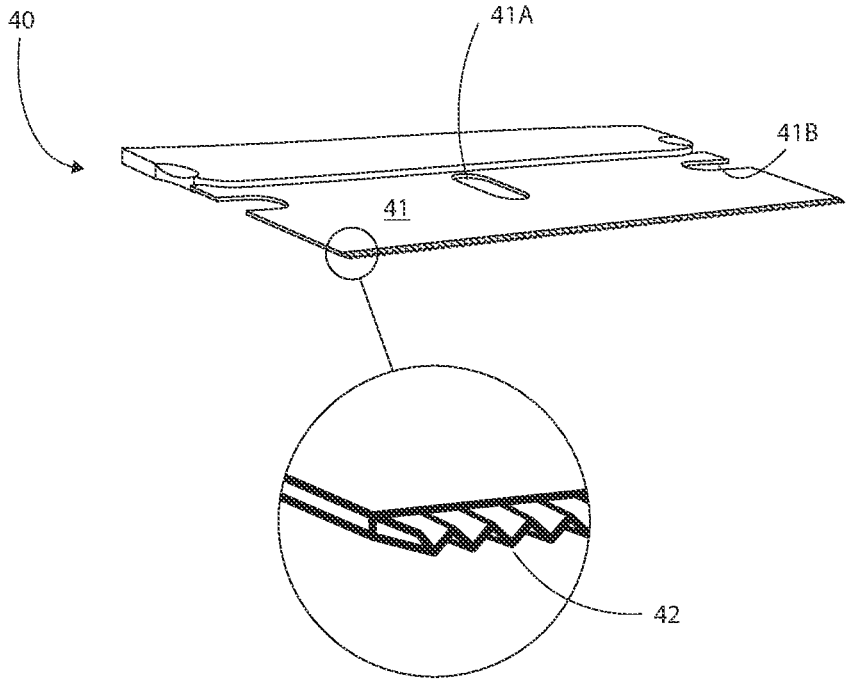
FIG. 12 is a perspective view of the cutting blade device of FIG. 11.

Referring now to FIGS. 11 and 12, a cutting blade device in accordance with another variant of the present disclosure is generally shown at 40. The cutting blade device 40 is of the type that may be used for razor slitting. Thus, a plurality of the cutting blade device 40 may be mounted at an angle in individual holders or as multiples in cassettes to slit the moving web. The cutting blade device 40 may be used in different razor slitting set-ups, such as Razor-in-Air (top) and Razor-in-Groove (bottom). The former requires no extra support at the slitting area and is better for slower speeds. The latter uses a roll with grooves that provide additional support at the point of slitting for higher running speeds. Razor slitting has lower tooling costs, with simple adjustment and maintenance. It's generally best used for thin films and light foils. The cutting blade device 40, also known as a razor blade, can be made of metal or other types of materials such as ceramic. For example, FIGS. 11 and 12 show one such cutting blade device 40. The device 40 has a plate body 41, that may be a flat plate, or may have a thicker connection edge as shown in FIG. 12. Various slots or connector formations may be present, such as slot 41A and notches 41B. Other connector formations include holes, depressions, etc. An edge 42 of the cutting blade device 40 is sharp and thus configured to perform the slitting and/or cutting. Still has observed in FIG. 12, the edge 42 may have a serrated pattern. In an alternative embodiment, the edge 42 has a single elongated straight blade equivalent to the circular blade 14, and a plurality of transverse blades equivalent to the transverse blades 15.

While the slitting device 10, the cutting die device 20 and the cutting blade device 40 are well suited to be used with a tape 1 having a polymeric facestock 2, these tools may be used with facestocks including one or more of paper, cloth, fabric, thin metal foil, aluminum foil, laminated paper, laminated fabric, rubber, silicone rubber, silicone, to name a few examples.

The invention claimed is:

1. A slitter device comprising:

a disc body having a single circular blade at an outer periphery of the slitter device and at least one row of transverse blades at the outer periphery and on a side of the circular blade, the blades of the row of transverse blades being oriented transversely relative to the single circular blade.

2. The slitter device according to claim 1, including two rows of the transverse blades, with the rows being on opposite sides of the circular blade.

3. The slitter device according to claim 1, wherein the transverse blades intersect the circular blade.

4. The slitter device according to claim 1, wherein at least one of the transverse blades lies in a plane perpendicular to a radial plane of the circular blade.

5. The slitter device according to claim 1, wherein all of the transverse blades lie in planes perpendicular to a radial plane of the circular blade.

6. The slitter device according to claim 1, wherein edges of the transverse blades are radially inward of an edge of the circular blade.

7. The slitter device according to claim 6, wherein the edges of the transverse blades are radially inward of the edge of the circular blade by a distance generally equal to a thickness of a support liner.

8. The slitter device according to claim 1, wherein at least one row of transverse blades project from an annular base.

9. The slitter device according to claim 8, wherein the at least one row of transverse blades includes triangular prisms projecting from the annular base.

10. The slitter device according to claim 8, wherein the transverse blades are fins.

11. The slitter device according to claim 1, wherein the circular blade is part of the disc body of the slitter device.

12. The slitter device according to claim 11, wherein the disc body has a central bore.

13. A cutting die device comprising:

a plate body configured to be positioned on a cylindrical surface and conform to a shape of the cylindrical surface;

circumferential blade edges projecting from a plane of the plate body, the circumferential blade edges configured to extend along a circumference of the cylindrical surface;

at least one row of transverse blade edges projecting from the plane of the plate body, the transverse blade edges being oriented transversely relative to the circumferential blade edges.

14. The cutting die device according to claim 13, including two rows of the transverse blade edges, with the rows being on opposite sides of one of the circular blade edges.

15. The cutting die device according to claim 13, including two rows of the transverse blade edges, with each one of the rows adjacent to a respective one of the circumferential blade edges.

16. The cutting die device according to claim 13, wherein the transverse blade edges intersect one of the circumferential blade edges.

17. A cutting die shaft comprising:

a solid die configuration including a shaft body having a cylindrical surface, circumferential blade edges projecting from the cylindrical surface, the circumferential blade edges configured to extend along a circumference of the cylindrical surface and at least one row of transverse blade edges projecting from the cylindrical surface, the transverse blade edges being oriented transversely relative to the circumferential blade edges.

18. The cutting die shaft according to claim 17, including two rows of the transverse blade edges, with the rows being on opposite sides of one of the circular blade edges.

19. The cutting die shaft according to claim 17, including two rows of the transverse blade edges, with each one of the rows adjacent to a respective one of the circumferential blade edges.

20. The cutting die shaft according to claim 17, wherein the transverse blade edges intersect one of the circumferential blade edges.

* * * * *